US008038510B2

(12) United States Patent
Tzeng et al.

(10) Patent No.: US 8,038,510 B2
(45) **Date of Patent: *Oct. 18, 2011**

(54) APPARATUS AND METHOD FOR SPIRAL POLISHING WITH ELECTROMAGNETIC ABRASIVE

(75) Inventors: Hsinn-Jyh Tzeng, Taipei (TW); Ming-Li Wu, Tainan Hsien (TW); Jen-Chou Hsiung, Kaohsiung (TW); Yan-Cherng Lin, Nantou County (TW); Shun-Fua Su, Taichung (TW); Chia-Tsung Chang, Nantou (TW)

(73) Assignee: Southern Taiwan University, Tainan County (TW)

( * ) Notice: Subject to any disclaimer, the term of this patent is extended or adjusted under 35 U.S.C. 154(b) by 275 days.

This patent is subject to a terminal disclaimer.

(21) Appl. No.: 12/260,481

(22) Filed: Oct. 29, 2008

(65) Prior Publication Data

US 2010/0105298 A1 Apr. 29, 2010

(51) Int. Cl.
*B24B 1/00* (2006.01)

(52) U.S. Cl. ..... 451/36; 451/113

(58) Field of Classification Search ..... 451/36, 451/48, 113
See application file for complete search history.

(56) References Cited

U.S. PATENT DOCUMENTS

| | | | | |
|---|---|---|---|---|
| 2,923,100 | A * | 2/1960 | Simjian | 451/36 |
| 4,724,853 | A * | 2/1988 | Hirose | 134/1 |
| 5,232,512 | A * | 8/1993 | Swain | 134/7 |
| 5,931,718 | A * | 8/1999 | Komanduri et al. | 451/36 |
| 5,957,753 | A * | 9/1999 | Komanduri et al. | 451/36 |
| 7,291,060 | B2 * | 11/2007 | Yan et al. | 451/113 |
| 2003/0153249 | A1 * | 8/2003 | Aoki | 451/39 |
| 2010/0136887 | A1 * | 6/2010 | Tzeng | 451/36 |

* cited by examiner

*Primary Examiner* — Maurina Rachuba
(74) *Attorney, Agent, or Firm* — Rosenberg, Klein & Lee

(57) ABSTRACT

An apparatus and method for spiral polishing with electromagnetic abrasive has adopted the principle of electromagnetic and magnetic abrasive along with a lead screw to polish the inner or outer surface of a precise screw or a complicated part. The apparatus includes a clamp, a lead screw, a first electromagnet, and a second electromagnet assembled in an airtight space, wherein the airtight space is filled with magnetic abrasive which is driven by the rotation of the lead screw and the electromagnetic function to polish a processed part in a regular shape or in an irregular shape.

6 Claims, 3 Drawing Sheets

APPARATUS AND METHOD FOR SPIRAL POLISHING WITH ELECTROMAGNETIC ABRASIVE

BACKGROUND OF THE INVENTION

1. Field of the Invention

The present invention relates to an apparatus and a method for spiral polishing with electromagnetic abrasive, and more particularly to an apparatus and a method that use the principle of electromagnetic and magnetic abrasive along with a lead screw to polish a precise screw and the inner or outer surface of a complicated part in an irregular shape.

2. Description of the Prior Art

A conventional method of polishing a product can only use abrasive material to polish the surface of the product to eliminate the rough surface of the product, but the method and skill is not mature enough, in particular to work on a precision or on a complicated device, a few of the shortcomings are listed as follows:

1. The skill to remove burrs from the surface of a product is very limited;
2. The prior art can not refine a product from inside and outside of a tiny product, neither to work on either regular or irregular polishing;
3. The open working space may cause the particles flow in the air, which may be inhaled by people and damages their breathing system.
4. It is not appropriate to work on precision devices.
5. It is limited to work on a single object each time.
6. The abrasive is not reusable, thus it is not cost-effective.

All the prior art mentioned above about abrasive method is designed to work on a regular surface of a product, if the product has an irregular surface, the refinement can not be done properly.

In view of these, this invention provides a better method and apparatus to correct the above shortcomings.

SUMMARY OF THE INVENTION

An apparatus and method for spiral polishing with electromagnetic abrasive is to introduce an apparatus and method for a wide polishing application to meet the industrial requirements.

According to a first aspect of the present invention, there is provided an apparatus for spiral polishing with electromagnetic abrasive, comprising:

a clamp, being a rotatable clamping member;

a lead screw, being clamped by said clamp and having a first side, a second side and a bottom;

a first electromagnet, disposed at said first side of said lead screw and having a first end and a second end;

a second electromagnet, disposed at said second side of said lead screw and having a first end and a second end, said first end of said first electromagnet facing said first end of said second electromagnet, the magnetism of the first end of said second electromagnet being opposite to the magnetism of said first end of said first electromagnet; and an accommodating unit, having an airtight space therein to accommodate said clamp, said lead screw, said first electromagnet and said second electromagnet, said accommodating unit further comprising abrasive therein.

Preferably, each of said first electromagnet and said second electromagnet has a feeding hole vertically formed therein.

Preferably, said abrasive is magnetic particles.

Preferably, the bottom of said lead screw is sustained by a supporting member, said supporting member being rotatable and comprising a number of blades thereon.

According to a second aspect of the present invention, there is provided a method for spiral polishing with electromagnetic abrasive, comprising the following steps: spinning a clamp to link a lead screw to spin simultaneously; a first electromagnet and a second electromagnet attracting abrasive provided in an airtight space to enter a gap among said first electromagnet, said second electromagnet and said screw lead; driving said abrasive to move upward along with said lead screw and forcing said abrasive in touch with said lead screw to polish said lead screw because said abrasive is subjected to opposite magnetisms of said first electromagnet and said second electromagnet; said abrasive driven by said lead screw flowing through feeding holes of said first electromagnet and said second electromagnet back to the airtight space for reuse.

Preferably, each of said first electromagnet and said second electromagnet has a length longer than a processed section of said lead screw.

According to a third aspect of the present invention, there is provided an apparatus for spiral polishing with electromagnetic abrasive, comprising:

a clamp, being a rotatable clamping member;

a lead screw, being clamped by said clamp and having a first side, a second side and a bottom;

a first electromagnet, disposed at said first side of said lead screw and having a first end and a second end;

a second electromagnet, disposed at said second side of said lead screw and having a first end and a second end, said first end of said first electromagnet facing said first end of said second electromagnet, the magnetism of the first end of said second electromagnet being the same as the magnetism of said first end of said first electromagnet;

a fixture, having a number of holes thereon;

a processed object, having an inner bore surface to be polished and being secured by said fixture and located among said first electromagnet, said second electromagnet and said lead screw; and an accommodating unit, having an airtight space therein to accommodate said clamp, said lead screw, said first electromagnet, said second electromagnet, said fixture, and said processed object, said accommodating unit further comprising abrasive therein.

Preferably, each of said first electromagnet and said second electromagnet has a feeding hole vertically formed therein.

Preferably, said abrasive is magnetic particles.

Preferably, the inner bore surface to be polished of said processed object is in an inner thread shape or in an irregular shape.

Preferably, the bottom of said lead screw is sustained by a supporting member, said supporting member being rotatable and comprising a number of blades thereon.

According to a fourth aspect of the present invention, there is provided a method for spiral polishing with electromagnetic abrasive, comprising the following steps: spinning a clamp to link a lead screw to spin simultaneously; a first electromagnet and a second electromagnet attracting abrasive provided in an airtight space to enter a gap between a processed object and said screw lead; driving said abrasive to move upward along with said lead screw and forcing said abrasive to push and polish an inner bore surface of said processed object because said abrasive is subjected to the repellence of the same magnetism of said first electromagnet and said second electromagnet; said abrasive driven by said lead screw flowing through holes of a fixture and feeding holes of said first electromagnet and said second electromagnet back to the airtight space for reuse.

Preferably, each of said first electromagnet and said second electromagnet has a length longer than that of said processed object.

It is another object of the present invention to provide an apparatus and method for spiral polishing with electromagnetic abrasive, which can polish any burrs of other object on from the surface of the polished object.

It is still another object of the present invention to provide an apparatus and method for spiral polishing with electromagnetic abrasive, which keeps all particles polished from the object in an airtight space that corresponds to the environment requirement.

It is still another object of the present invention to provide an apparatus and method for spiral polishing with electromagnetic abrasive, which has the best flowing effect for the abrasive.

It is a further object of the present invention to provide an apparatus and method for spiral polishing with electromagnetic abrasive, which simplifies the manufacture and is cost-effective.

It is still a further object of the present invention to provide an apparatus and method for spiral polishing with electromagnetic abrasive, which can work on a complicated object in and out.

It is still a further of the present invention to provide an apparatus and method for spiral polishing with electromagnetic abrasive, which provides abrasive reusable from time to time, thus the cost has dropped to the minimum.

DETAILED DESCRIPTION OF THE PREFERRED EMBODIMENTS

Figure 1:
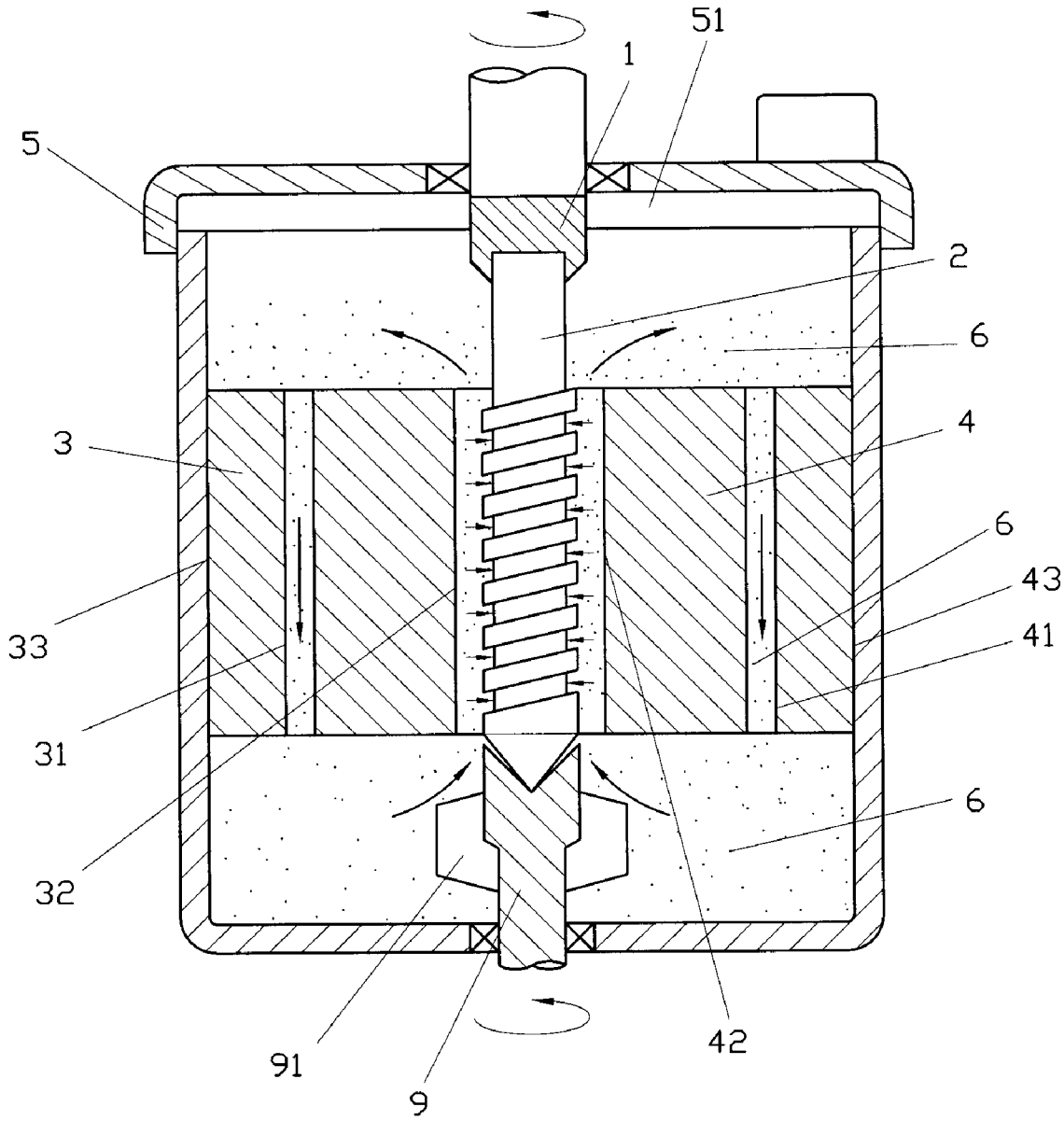
FIG. 1 is a cross-sectional view of a first preferred embodiment of the present invention showing the outer surface of a lead screw in a polishing status.

FIG. 1 is a schematic view of a first preferred embodiment of the present invention for polishing the outer surface of a lead screw. An apparatus for spiral polishing with electromagnetic abrasive comprises a clamp 1, a lead screw 2, a first electromagnet 3, a second electromagnet 4, an accommodating unit 5, abrasive 6, and a supporting member 9.

The clamp 1 is a rotatable clamping member.

The lead screw 2 is clamped by the clamp 1 and has a first side, a second side and a bottom.

The first electromagnet 3 is disposed at the first side of the lead screw 2 and has a first feeding hole 31 vertically formed therein. The first electromagnet 3 further has a first end 32 and a second end 33.

The second electromagnet 4 is disposed at the second side of the lead screw 2 and has a second feeding hole 41 vertically formed therein. The second electromagnet 4 further has a first end 42 and a second end 43. The first end 32 of the first electromagnet 3 faces the first end 42 of the second electromagnet 4. The magnetism of the first end 42 of the second electromagnet 4 is opposite to magnetism of the first end 32 of the first electromagnet 3.

The accommodating unit 5 has an airtight space 51 to accommodate the clamp 1, the lead screw 2, the first electromagnet 3, and the second electromagnet 4.

The abrasive 6 disposed in the airtight space 51 of the accommodating unit 5 is magnetic particles.

The supporting member 9 is able to rotate and sustains the bottom of the lead screw 2. The supporting member 9 comprises a number of blades 91 which are rotated along with the lead screw 2 to stir and to circulate the abrasive 6 in the accommodating unit 5 to make the best result of the polishing.

To process the polishing with the aforesaid apparatus as shown in FIG. 1, spin the clamp 1 which will link the lead screw 2 to spin simultaneously, whereas the first electromagnet 3 and the second electromagnet 4 will suck the abrasive 6 in the bottom of the airtight space 51 to move upwards and into the gap among the first electromagnet 3, the second electromagnet 4 and the lead screw 2. The abrasive 6 will also be driven by the lead screw 2 to move upward. The opposite magnetisms (S-N and N-S) of the first electromagnet 3 and the second electromagnet 4 will force the abrasive 6 towards the lead screw 2, thus the upward rotation of the abrasive 6 will provide pushing and polishing functions on the to-be-polished lead screw 2. The abrasive 6 driven by the lead screw 2 will flow through the first feeding hole 31 of the first electromagnet 3 and the second feeding hole 41 of the second electromagnet 4 back into the airtight space 51 for reuse.

In order to stabilize the rotation of the lead screw 2, other than securing the top of the lead screw 2 to the clamp 1, the bottom of the lead screw 2 is sustained by the supporting member 9 to prevent swing movement too strong caused by the flexibility of a suspension arm, increasing the stability and precision while processing.

In order to increase the flowing of the abrasive 6 during processing to enhance the circulation effect of the abrasive 6, the supporting member 9 is provided with the blades 91 to be rotated with the spinning of the lead screw 2 to increase the stirring and circulation of the abrasive 6.

In order to be sure that the magnetic field of the electromagnet covers the lead screw 2 effectively, the lengths of the first electromagnet 3 and the second electromagnet 4 must be longer than the length of the lead screw 2.

Figure 2:
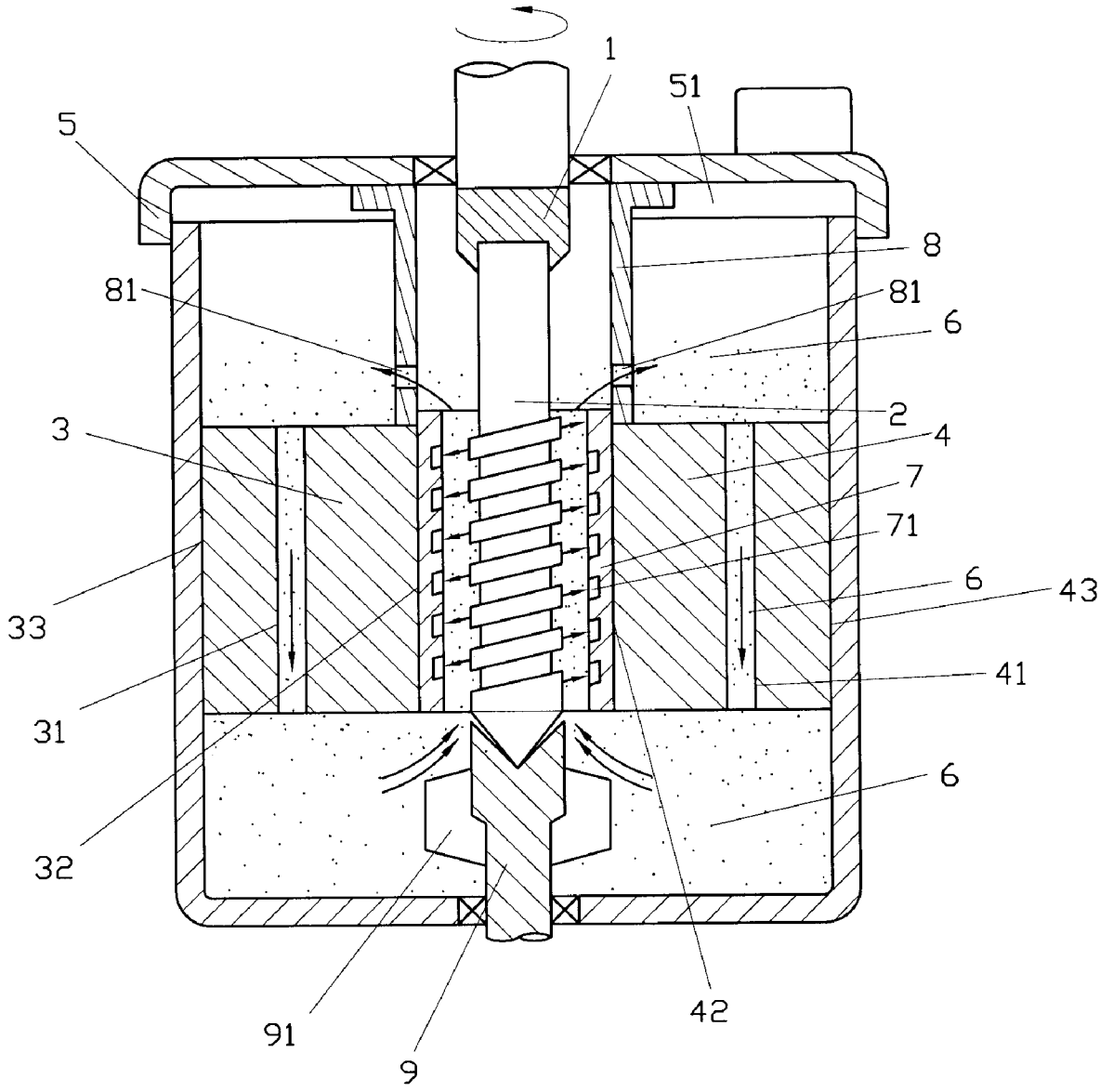
FIG. 2 is a cross-sectional view of a second preferred embodiment of the present invention showing a regular-shaped inner bore of a lead screw in a polishing status.

FIG. 2 is a schematic view of a second preferred embodiment of the present invention for polishing the regular-shaped surface of an inner hole. An apparatus for spiral polishing with electromagnetic abrasive comprises a clamp 1, a lead screw 2, a first electromagnet 3, a second electromagnet 4, an accommodating unit 5, abrasive 6, a processed object 7, a fixture 8 and a supporting member 9.

The clamp 1 is a rotatable clamping member.

The lead screw 2 is clamped by the clamp 1 and has a first side, a second side and a bottom.

The first electromagnet 3 is disposed at the first side of the lead screw 2 and has a first feeding hole 31 vertically formed therein. The first electromagnet 3 further has a first end 32 and a second end 33.

The second electromagnet 4 is disposed at the second side of the lead screw 2 and has a second feeding hole 41 vertically formed therein. The second electromagnet 4 further has a first end 42 and a second end 43. The first end 32 of the first electromagnet 3 faces the first end 42 of the second electromagnet 4. The magnetism of the first end 42 of the second electromagnet 4 is the same as the magnetism of the first end 32 of the first electromagnet 3.

The accommodating unit 5 has an airtight space 51 to accommodate the clamp 1, the lead screw 2, the first electromagnet 3, and the second electromagnet 4.

The abrasive 6 disposed in the airtight space 51 of the accommodating unit 5 is magnetic particles.

A processed object 7 has an inner bore surface 71 to be polished and is secured by the fixture 8 to the place among the first electromagnet 3, the second electromagnet 4 and the lead screw 2.

The fixture 8 has a number of holes 81.

The supporting member 9 is able to rotate and sustains the bottom of the lead screw 2. The supporting member 9 comprises a number of blades 91 which are rotated along with the lead screw 2 to stir and to circulate the abrasive 6 in the accommodating unit 5 to make the best result of the polishing.

Figure 3:
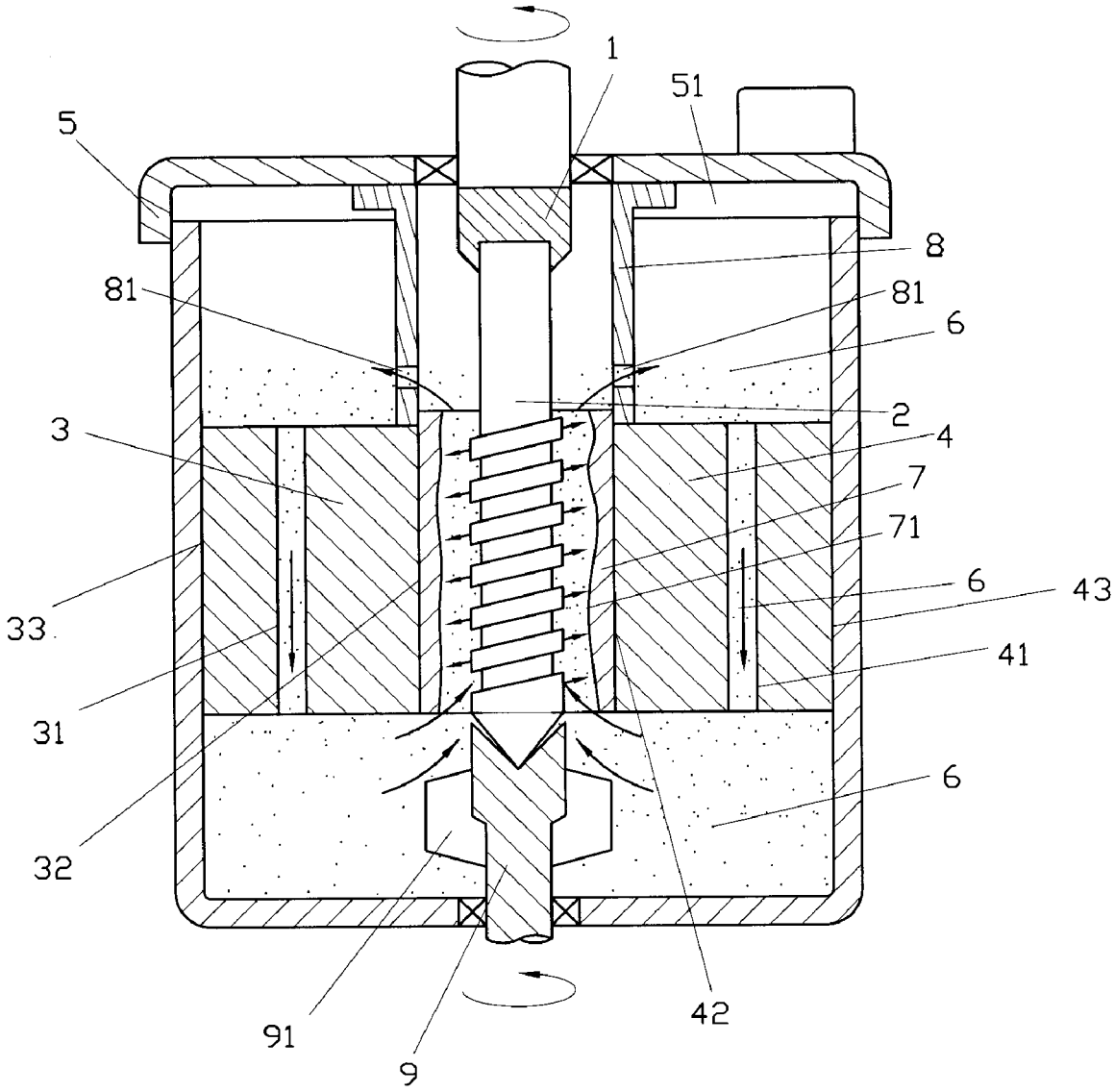
FIG. 3 is a cross-sectional view of a third preferred embodiment of the present invention showing an irregular-shaped inner hole of a lead screw in a polishing status.

To work on the inner bore surface 71 of the processed object 7, the inner bore surface 71 either has a regular shape, as shown in FIG. 2, or has an irregular shape, as shown in FIG. 3, the method of polishing would be as follows:

Spin the lead screw 2 by means of the clamp 1, which activates the first electromagnet 3 and the second electromagnet 4 to suck the abrasive 6 in the bottom of the airtight space 51 upward and into the gap between the lead screw 2 and the processed object 7. The same magnetism (N-N and S-S) of the first electromagnet 3 and the second electromagnet 4 will urge the abrasive 6 towards the inner bore surface 71 of the processed object 7. The abrasive 6 is continuous to move upward along with the lead screw 2 and flow out from the holes 81 of the fixture 8 and through the first feeding hole 31 and the second feeding hole 41 back into the airtight space 51.

In order to stabilize the rotation of the lead screw 2, other than securing the top of the lead screw 2 to the clamp 1, the bottom of the lead screw 2 is sustained by the supporting member 9 to prevent swing movement too strong caused by the flexibility of a suspension arm, increasing the stability and precision while processing.

In order to increase the flowing of the abrasive 6 during processing to enhance the circulation effect of the abrasive 6, the supporting member 9 is provided with the blades 91 to be rotated with the spinning of the lead screw 2 to increase the stirring and circulation of the abrasive 6.

The holes 81 of the fixture 8 are well designed both in quantity and in position to ensure the abrasive 6 to flow smoothly during processing.

In order to have the magnetism field effectively cover the inner bore surface 71 of the processed object 7, the lengths of the first electromagnet 3 and the second electromagnet 4 must be longer than the length of the inner bore surface 71 of the processed object 7.

Above all, the apparatus and method for spiral polishing with electromagnetic abrasive of the present invention utilizes the principle of electromagnetism and magnetic abrasive along with the mechanism of the lead screw to work on a precise screw or a complicated object and produce a best refinement.

What is claimed is:

1. An apparatus for spiral polishing with electromagnetic abrasive, comprising:

a clamp, being a rotatable clamping member;

a lead screw, being clamped by said clamp and having a first side, a second side and a bottom;

a first electromagnet, disposed at said first side of said lead screw and having a first end and a second end;

a second electromagnet, disposed at said second side of said lead screw and having a first end and a second end, said first end of said first electromagnet facing said first end of said second electromagnet, the magnetism of the first end of said second electromagnet being opposite to the magnetism of said first end of said first electromagnet; and an accommodating unit, having an airtight space therein to accommodate said clamp, said lead screw, said first electromagnet and said second electromagnet, said accommodating unit further comprising abrasive therein.

2. The apparatus for spiral polishing with electromagnetic abrasive, as recited in claim 1, wherein each of said first electromagnet and said second electromagnet has a feeding hole vertically formed therein.

3. The apparatus for spiral polishing with electromagnetic abrasive, as recited in clai wherein said abrasive is magnetic particles.

4. The apparatus for spiral polishing with electromagnetic abrasive, as recited in claim 1, wherein the bottom of said lead screw is sustained by a supporting member, said supporting member being rotatable and comprising a number of blades thereon.

5. A method for spiral polishing with electromagnetic abrasive, comprising the following steps: spinning a clamp to link a lead screw to spin simultaneously; a first electromagnet and a second electromagnet attracting abrasive provided in an airtight space to enter a gap among said first electromagnet, said second electromagnet and said screw lead; driving said abrasive to move upward along with said lead screw and forcing said abrasive in touch with said lead screw to polish said lead screw because said abrasive is subjected to opposite magnetisms of said first electromagnet and said second electromagnet; said abrasive driven by said lead screw flowing through feeding holes of said first electromagnet and said second electromagnet back to the airtight space for reuse.

6. The method for spiral polishing with electromagnetic abrasive, as recited in claim 5, wherein each of said first electromagnet and said second electromagnet has a length longer than a processed section of said lead screw.

* * * * *